United States Patent [19]

Kasparian et al.

[11] 4,418,540

[45] Dec. 6, 1983

[54] POWER SYSTEM AND METHOD

[76] Inventors: Hagop Kasparian, P.O. Box 172, Al Khobar, Saudi Arabia; Kaspar Kasparian, P.O. Box 58252, Raleigh, N.C. 27658

[21] Appl. No.: 140,294

[22] Filed: Apr. 14, 1980

[51] Int. Cl.[3] ..... F01K 25/00

[52] U.S. Cl. ..... 60/649; 60/673; 60/670

[58] Field of Search ..... 60/643, 649, 645, 673, 60/670, 39.46 S, 39.05, 39.55; 110/341, 344; 122/27, 28, 40; 44/4

[56] References Cited

U.S. PATENT DOCUMENTS 2,764,109 9/1956 Grosse ..... 110/341

4,129,003 12/1978 Smith, Jr. ..... 60/517 X

*Primary Examiner*—Allen M. Ostrager

*Attorney, Agent, or Firm*—Frank A. Steinhilper

[57] ABSTRACT

A new power system employs aluminum as a primary fuel resulting in a total energy/volume ratio several times more favorable than gasoline. The system includes a fuel store, a reactor which may be the same mechanical element as the store and means to utilize the released energy. Illustratively, aluminum may be reacted with steam to form aluminum oxide with the release of large quantities of usable energy. After the reaction, the aluminum oxide may be reconverted to aluminum.

3 Claims, 9 Drawing Figures

POWER SYSTEM AND METHOD

BACKGROUND OF THE INVENTION

This invention relates to a new power system. More particularly, this invention pertains to a power system with a cycle in which metallic aluminum is ignited and burned as a synthetic primary fuel in air, or air and water, or other ways, for the production of energy. This system allows the regeneration of the primary fuel through the input of electric energy and the cycle can then be repeated. The energy release per unit weight and volume of the primary fuel compares favorably with conventional fossil fuels.

In today's world, energy is a particularly important concern. The concern is compounded by increasing energy demands and the shortage of certain energy sources. In particular, petroleum and related products, such as fuel oil, natural gas and gasoline have become a major form of energy and are threatening to become more scarce. These products have become extremely important in many ways and one of them is as a mobile or portable fuel or energy supply. Automobiles and other vehicles are dependent on a fuel supply that, by virtue of its characteristics, can be carried with them. The continued availability of petroleum products for this purpose and other applications is becoming a danger area. Thus, there is an important and continuous search for new sources and forms of energy.

Among the usual criteria that are of paramount importance in the consideration of various energy sources are the following: availability of primary ingredients, cost, technology involved, energy yield/weight ratio, environmental considerations, storage considerations, safety considerations and transportability.

Based on the technology of the foreseeable future, one of the most common types of energy in the future that need not be dependent on petroleum proudcts for its generation is expected to be elecricity. Among the various approaches that are in use or are expected to be utilized for the future generation of electricity are: coal, nuclear fission, tides, waves, sun, wind, geothermal, etc. Thus, we can depend on electricity as being available for the foreseeable future.

While electricity is quite likely to satisfy a wide variety of energy demands in the future, it has, so far, been difficult to make extensive use of it as a mobile power source. For such use, energy content per weight and volume of the common electric storage devices has become a limiting criterion.

The present invention with its various embodiments relates to a power system that provides energy through burning a metal and then utilizing electric energy to reconvert the residue back into useable metallic fuel again. Since the metal used as a primary fuel, aluminum, is regenerated or produced from aluminum oxide using electric energy, it may be called a synthetic fuel. In the system, aluminum is burned in air, or in air and water or in other ways for the production of energy. Aluminum oxide and other compounds are formed, depending on the actual reaction utilized. The aluminum oxide can be recycled by the input of electric energy to regenerate metallic aluminum.

An interesting energy conversion cycle is thus achieved, whereby part of the energy used in the electric regeneration of the synthetic fuel is released in other forms with a yield per weight and in volume that compares favorably with fossil fuels. This system, in effect provides a subtle means of "storing" energy during the electric regeneration process of the fuel and allowing its utilization in other form, when required, to power vehicles, or the like, or as described in the various embodiments of this invention. With the input of electric energy for the regeneration of the fuel, the cycle can be repeated.

In the past, aluminum has been proposed for releasing hydrogen and as a possible constituent, among other metals, in systems utilizing other primary fuel material such as lithium or lithium compounds. A system employing aluminum for the generation of hydrogen which in turn is used in a torpedo propulsion system is disclosed in U.S. Pat. No. 3,229,462. It is not believed that aluminum has previously been employed as a primary synthetic fuel for the direct production of power through the system in this invention with the energy conversion cycle earlier described.

Among the apparent positive aspects of this invention are the following:

1—In the power system of this invention, the amount of energy released per unit weight of the fuel when it reacts with oxygen is close to the energy released per unit weight of gasoline when ignited.

2—The energy that can be released per unit volume of the fuel is approximately three times higher than the amount of energy released per unit volume of gasoline burned.

3—Since high temperatures are reached when aluminum burns in air, steam and air/steam combinations, equal or better thermodynamic efficiences may be reached in comparison to oil and gas.

4—Since the fuel in this power system burns in an air/steam combination, high temperature steam may be directly produced and utilized in various ways.

5—Greater amounts of heat can be added to the primary fuel prior to its combustion as compared to fossil fuels.

6—Since aluminum is a metal, when it burns in air, steam and air/steam combinations, the vaporized aluminum in this power system is electrically conducting. As such, it can be advantageously used in magnetohydrodynamic generators (MHD), since the high temperature gas produced is not required to "seed with a metal" as when oil or petroleum is used.

7—While burning in air or steam/air combinations, no uncontrollable environmental pollutants are produced.

8—The oxidized metal residue of the fuel is the main necessary raw material required in preparing the synthetic primary fuel by electricity. The synthetic fuel can be recycled indefinitely, as long as electricity exists.

9—The raw material used in the preparation of the primary fuel is the most abundant metal in the earth's crust.

10—The primary fuel of this invention is easily transportable and non-hazardous during transport, unlike gas, petroleum or hydrogen.

This invention has many applications which by no means are to be understood as being limited to what is herein covered or implied. Among other things, this invention may be utilized in the transportation sector because of the positive aspects described earlier, and particularly, since the primary fuel employed in this invention compares favorably with fuels in power plants operating on the conventional fossil fuels. The fossil fuels are threatening to become scarce and are not regenerated.

The invention is further illustrated in the drawings in which.

SPECIFIC DESCRIPTION OF THE INVENTION

Figure 1:
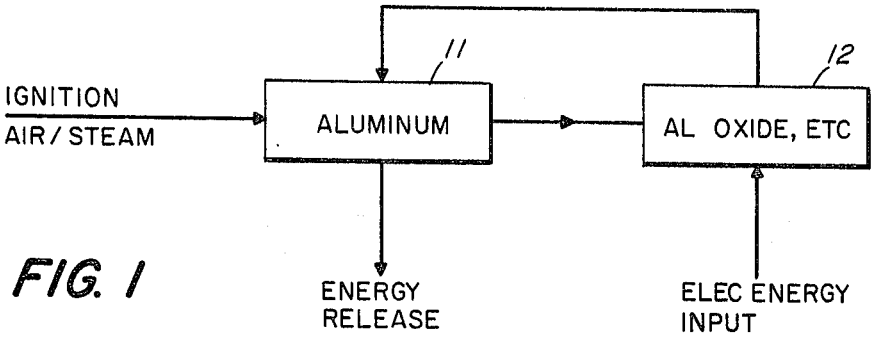
FIG. 1 is a diagram of the basic energy conversion cycle used in the power plant of this invention.

Referring to the drawings, FIG. 1 is a simplified flow chart of the energy release and energy input cycle of the power plant of this invention. Metallic aluminum 11 is ignited and releases energy forming aluminum compound 12. The aluminum compound produced in the combustion may be converted back into metallic aluminum using the input of electric energy. Theoretical energy release comparisons of aluminum with respect to gasoline are detailed elsewhere in this description.

Table 1 is a tabulation of the energy release comparison of gasoline and the primary fuel used in this invention. The actual energy release from aluminum depends on the reaction used and its range is shown in the table. It is obvious that aluminum compares favorably with respect to gasoline. Specifically, as shown in the Table, aluminum may release between about 7394 and about 12,354 calories per gram of aluminum, compared with about 10,000 calories per gram of gasoline, thus being equivalent to about 74 to 124% more in potential energy content per unit weight compared with gasoline. On a volume basis, however, aluminum contains about 3 times more potential energy as gasoline, releasing about 19,963 to about 33,355 calories per $cm^3$ compared with about 7,000 calories per $cm^3$ for gasoline.

TABLE 1

| | WEIGHT BASIS (per gram) | VOLUME BASIS (per $cm^3$) |
|---|---|---|
| Aluminum Energy Release | 7,394 to 12,354 cal | 19,963 to 33,355 cal |
| Gasoline Energy Release | 10,000 cal | 7,000 cal |
| % Potential Energy Content of Aluminum Relative to Gasoline | 74% to 124% | 285% to 477% |

Figure 2:
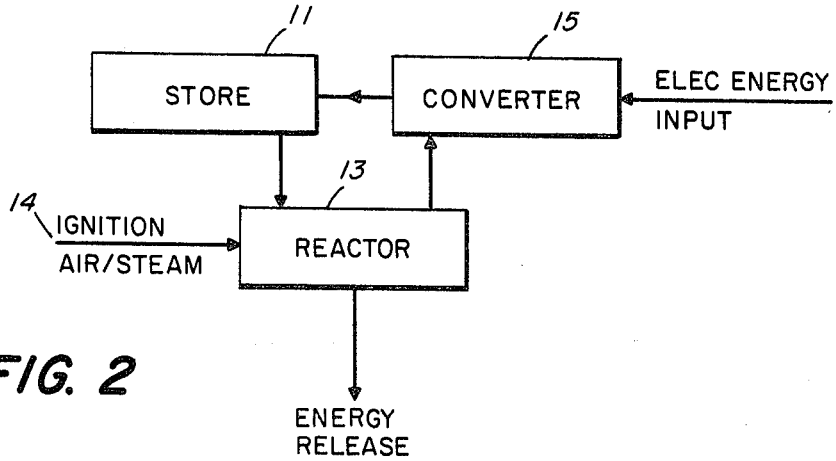
FIG. 2 is a flow chart of the operation of the basic power plant of this invention.

FIG. 2 is a flow chart describing the operation of the power plant of this invention. Store 11 contains metallic prepared aluminum. The preparation may include physical and/or chemical modification of the aluminum to maximize the efficiency of the cycle or to control physical and mechanical combustion products as required in an application. The aluminum may also be separately added in suitable form to store 11 in essentially the same way gasoline is added to the gasoline tank of a vehicle. The next step is the combustion of the aluminum in reactor 13. It is to be understood that the reactor 13 may be the same physical or mechanical element as store 11. The aluminum may be ignited by electric arc, microwave induced energy or other means. Additional combustion aiding materials such as air, water, steam 14 or the like may be introduced and combustion conditions will be stimulated or maintained or controlled by suitable means with respect to the particular application. The reactor 13 and/or subsequent equipment may be expected to release exhaust gases and also may be expected to emit an aluminum compound as an exhaust. In the event that the aluminum is reacted or burned in air and steam, the aluminum compound will be aluminum oxide which vaporizes at a temperature of 2250 degrees C. The aluminum oxide may be reconverted to metallic aluminum through the input of electric power to converter 15 which may be the same physical or mechanical element as store 11 and reactor 13 or a separate unit depending on the embodiment. Alternately, the aluminum oxide may be leached then converted into aluminum through the input of electric energy. The converter 15 may be physically and mechanically fixed in the system or may be removable therefrom for external conversion.

The amount of energy consumed in the production of aluminum from its oxide depends on the method and is approximately 6 to 10 kilowatt hours per pound of aluminum, i.e., about 11.37 to 18.95 KCal/gram. As shown in Table 1, the amount of energy released when aluminum is oxidized is 7.39 to 12.35 KCal/gm depending on the reaction. Based on the aforementioned, the efficiency of the energy release in relation to the energy used to recycle the fuel varies from 39% ($7.39/18.96\times100$) to about 100%. This indicates that, depending on the method utilized to oxidize and regenerate the fuel, theoretically 39% to about 100% of the energy used in its recycling could be recovered.

Figure 3:
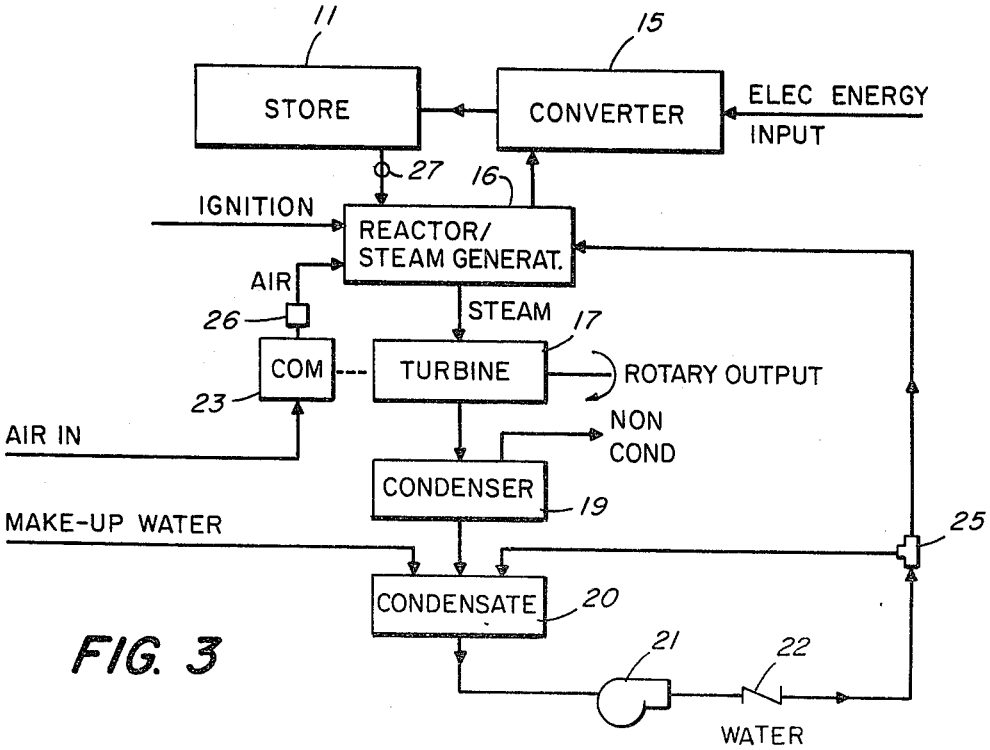
FIG. 3 is a flow chart of a steam turbine system embodying the power plant of the invention.

FIG. 3 is a flow chart of a steam turbine system embodying the power plant of the invention. Aluminum from store 11 is fed in suitable form to reactor/steam generator 16 where it is ignited to release energy and generate steam. The reaction produces aluminum compounds which are fed into an external or local converter 15, depending on the application, where reconversion is made into aluminum through the input of electric energy for reuse in store 11. The steam generated is supplied to drive turbine 17. It then goes into condenser 19 and a condensate tank 20 if required in application. The water is then pumped by pump 21 through check valve 22 and is supplied back to the reactor 16. Compressor 23 supplies the required air to reactor 16. Appropriate controls may be utilized to control the system and the rate of power through controls such as three-way valve 25, air pressure regulator 26 and feed control 27. Such controls may be coordinated automatically and activated by a human operator or automatically, such as through temperature, pressure and demand sensors. The output of turbine 17 may be used to propel a vehicle or other device with the employment of the required power transmission system. Also, the other hot gases produced in the reactor may be used to drive other types of turbines.

Figure 4:
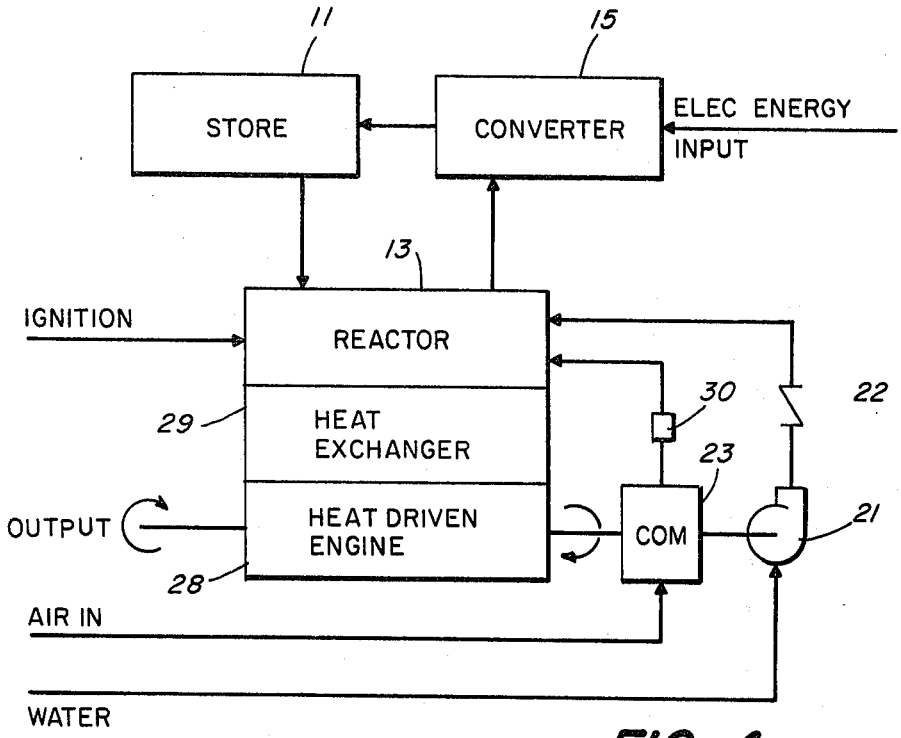
FIG. 4 is a flow chart of a power plant as embodied with a heat driven engine.

FIG. 4 is a flow chart of the power plant as embodied with a heat driven engine. In this embodiment, aluminum is ignited in reactor 13 and generates heat which is used via heat exchanger 29 to run an engine 28 designed for operation on a heat source, such as a Stirling Cycle engine. Compressor 23 with control 30 and pump 21 supply air and water to reactor 13. Alternately, the water may first be converted into steam through contact with heat exchanger 29 and recuperated through a condensation cycle similar to that of FIG. 3. The heat exchanger 29 may utilize a liquid, solid or gas medium to transfer heat to engine 28 and may also be part of the heat operated engine. In this embodiment too, the aluminum can be recycled in converter 15 through the input of electrical energy to be used again in store 11. Like in all embodiments, converter 15 may be adjoined to the system described or be situated elsewhere. Here too, appropriate controls can be used to regulate the rate of power production and to control the system for the required application.

Figure 5:
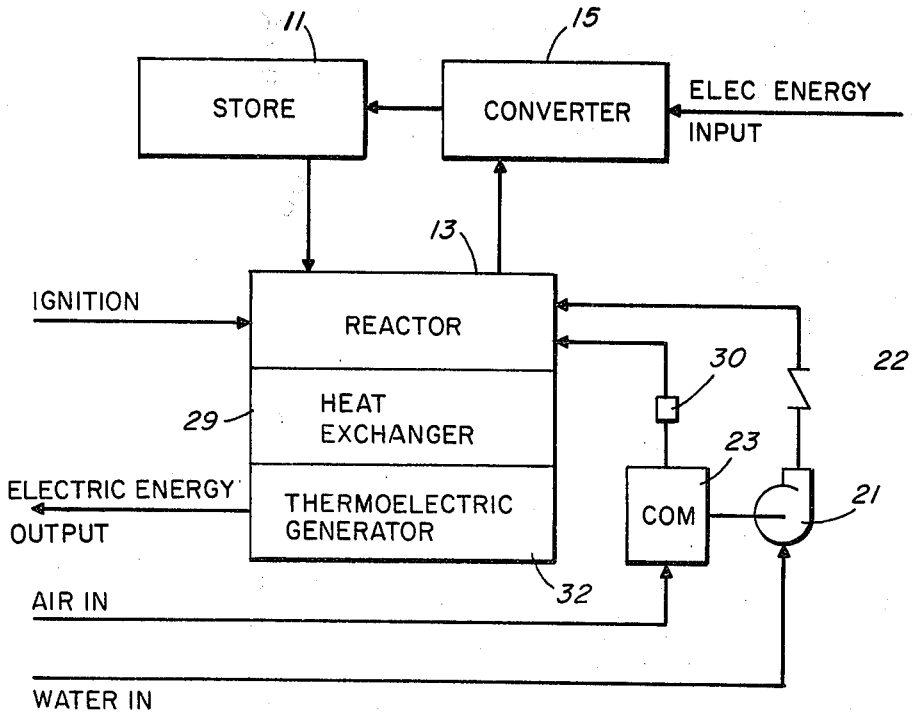
FIG. 5 is a flow chart of a thermoelectric generator embodying the power plant of this invention.

FIG. 5 is a flow chart of a thermoelectric generator embodying the power plant of the invention. In this embodiment, the heat produced in reactor 13 is utilized to generate electricity through a thermoelectric generator 32. This embodiment of the invention may be used for applications where, after electric energy is used to convert aluminum compound into aluminum, electricity becomes limited or unavailable, for example, in a power failure situation. In such cases, the system produces heat to be used for electric power generation, thus releasing back a portion of the energy used in regenerating the primary fuel. The system can be recycled when electricity becomes available. Alternately, the turbine 17 in FIG. 3 or the engine 28 in FIG. 4 may be used to generate electric power through the use of conventional electric generators.

Figure 6:
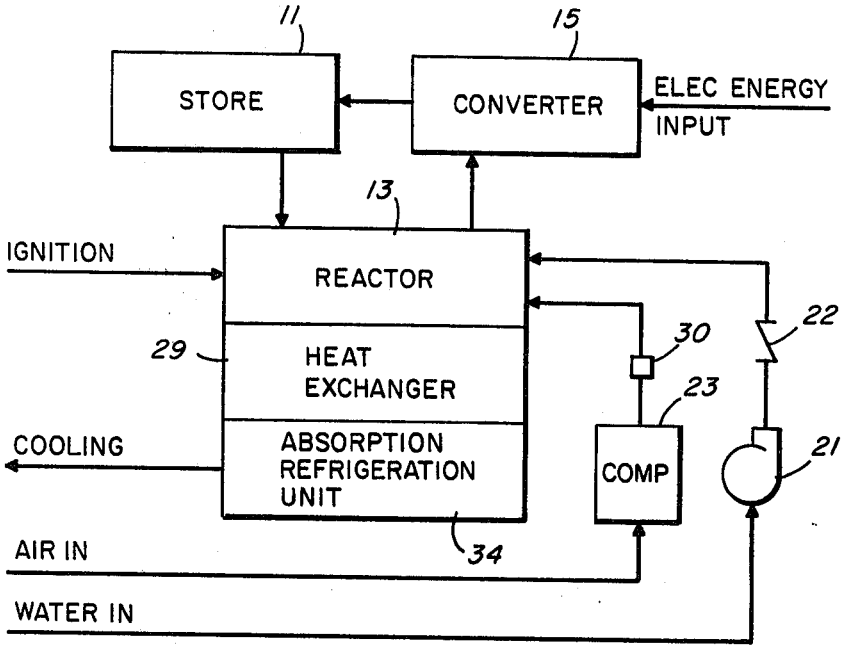
FIG. 6 is a flow chart of the power plant as embodied with an absorption type air conditioning or refrigeration system.

FIG. 6 is a flow chart of the power plant as embodied with an absorption type air conditioning or refrigeration system. In this embodiment, the heat produced in reactor 13 is used through a heat exchanger 29 to power an absorption type air conditioning or refrigeration system unit 4. Other elements performing functions like those of previous figures are similarly identified.

The heat may also be used to heat a liquid, solid or gas medium which may then be utilized to heat living space in residential, mobile or other applications. Once again, the primary fuel can be recycled locally or remotely depending on the application and reutilized.

Figure 7:
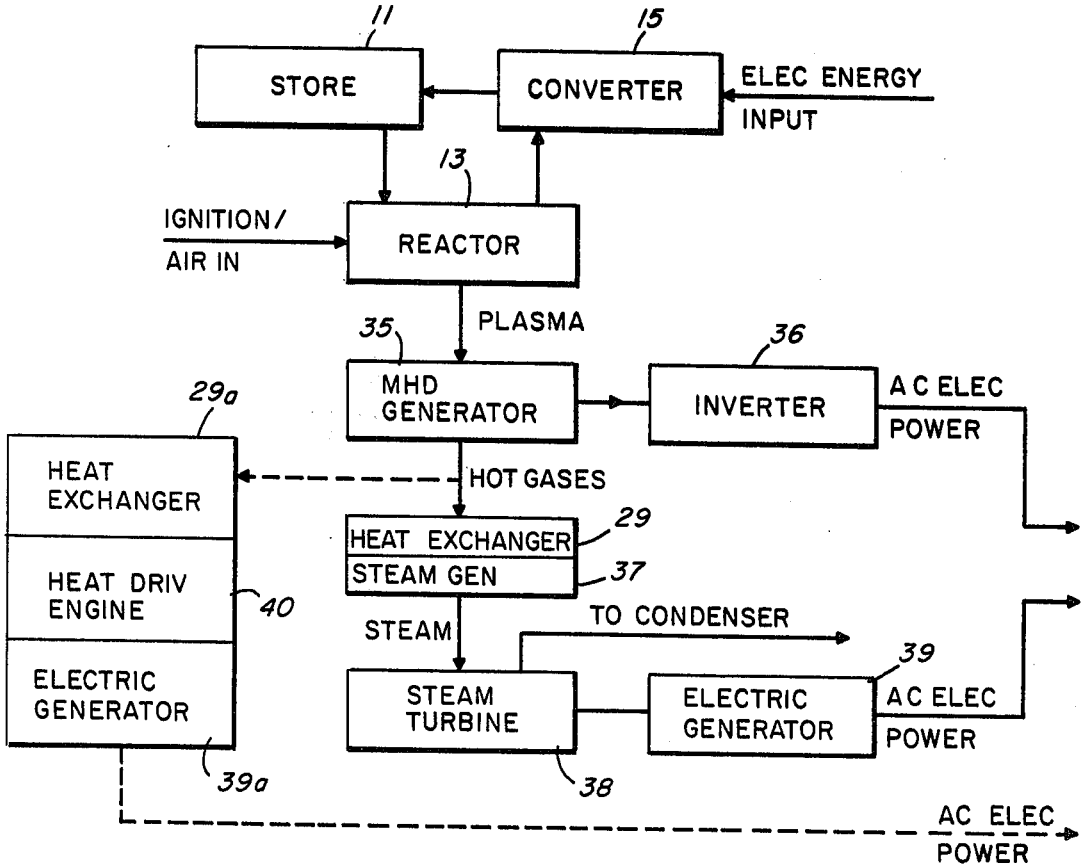
FIG. 7 is a flow chart of another embodiment of the invention in a magnetohydrodynamic electric power generation system.

FIG. 7 is a flow chart of another embodiment of the inventin in a magnetohydrodynamic electric power generation system. In this embodiment, the aluminum from store 11 is ignited in the reactor 13 where its vaporization and the conditions and products of the reaction induce a plasma which is supplied to an MHD generator 35 which produces D.C. electric power. The D.C. electric power is changed into A.C. electric power through inverter 36. The hot gas discharged by the MHD generator goes through heat exchanger 29 to steam generator 37. The steam that is generated powers turbine 38, which in turn drives electric generator 39 to produce A.C. electric power.

Alternately, the hot gases through a heat exchanger **29*a* may be used to drive a heat source driven engine 41 which will drive an electric generator 39*a***.

This two stage MHD plus turbine/generator system would be more efficient than just the turbine/generator alone. Here too, the aluminum may be recycled whenever or wherever electric power for its conversion is available.

Figure 8:
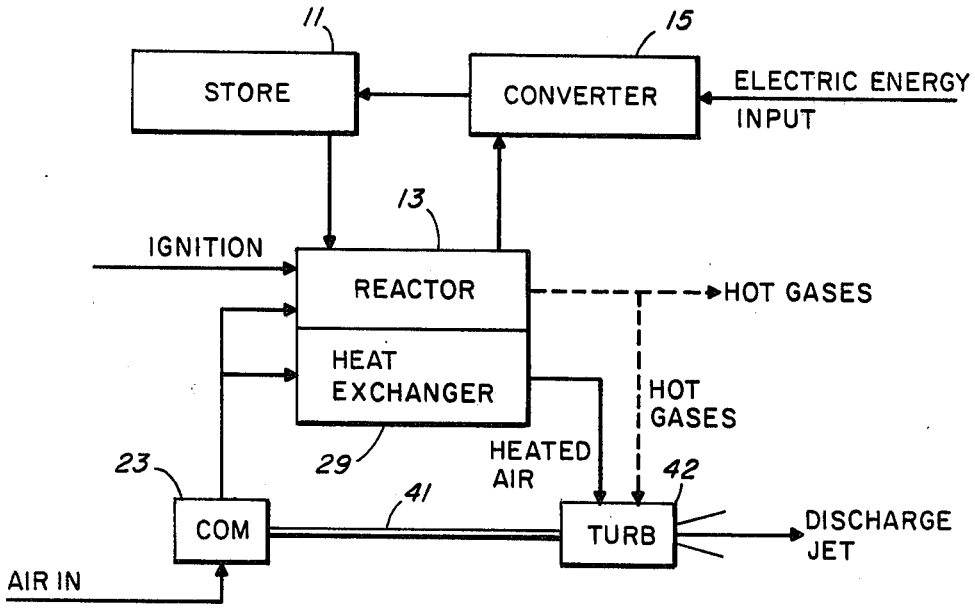
FIG. 8 is a flow chart of the power plant as embodied with a turbojet engine.

FIG. 8 is a flow chart of the power plant as embodied with a turbojet engine. In this embodiment, aluminum from store 11 is fed in suitable form to reactor 13 where it is ignited and burned to release energy. Compressor 23 supplies air to reactor 13 and also to heat exchanges 29 which heats the air that is supplied to drive turbine 42. Hot gases from reactor 13 may also be used to drive turbine 42 or an auxilliary turbine. The exhaust jet from turbine 42 is used for propulsion of vehicles. Turbine 42 also drives compressor 23 through a common shaft 41 or a transmission system. The reaction in reactor 13 produces aluminum compounds which are fed into an external or local converter 15, depending on the actual application, where reconversion is made into aluminum through the input of electric energy for reuse in store 11.

Figure 9:
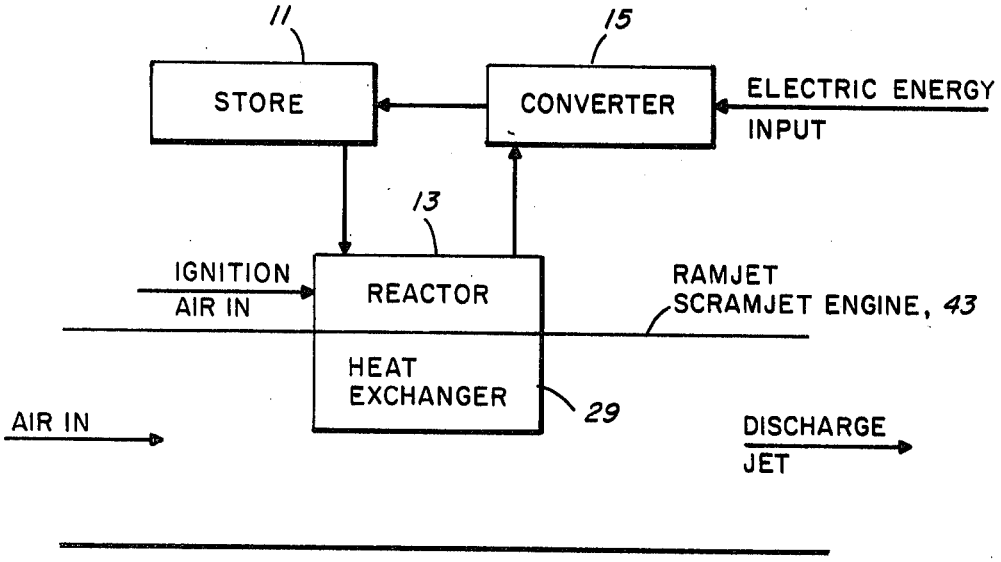
FIG. 9 is a flow chart of the power plant as embodied in a ramjet or scramjet engine.

FIG. 9 is a flow chart of the power plant as embodied in a ramjet or scramjet engine. In this embodiment, aluminum from store 11 is fed in suitable form to reactor 13 to which additional combustion aiding material such as air is introduced. Upon ignition and combustion of the aluminum in reactor 13, the energy released is brought in contact with the incoming air of ramjet or scramjet engine 43 through heat exchanger 29. The heated and expelled air from engine 43 produces thrust for propelling vehicles.

The foregoing disclosure illustrates a power system which can be embodied in various systems and which has numerous applications. There may be modifications and variations on the basic system described and on the modes of its applications, and each such modification is to be considered as part of the present invention. It is, therefore, to be understood that the invention may be put in practice other than in the form described herein, and that the invention is to be interpreted with reference to the following claims.

We claim:

1. A power system comprising a store of aluminum, a reactor for said aluminum, means to present said aluminum to said reactor, means to introduce steam into said reactor whereby said aluminum is converted to aluminum compound with the consequent release of energy, means to heat the steam with said released energy, a steam operated power device and means to operate said device with the heated steam, and means to convert said aluminum compound back to aluminum.

2. The power system of claim 1, wherein the steam operated power device is a turbine.

3. A method of energy conversion comprising reacting metallic aluminum with steam to form vaporized aluminum oxide with the consequent release of energy resulting from said reaction, collecting the vaporized aluminum oxide for reconversion to metallic aluminum and reconverting said aluminum oxide to aluminum by means of external energy, and utilizing the energy-containing steam from said reaction to operate a mechanical power device.

* * * * *